US005925861A

United States Patent [19]

Fromberg

[11] Patent Number: 5,925,861

[45] Date of Patent: Jul. 20, 1999

[54] SECURITY DOOR LOCK ARRANGEMENT WITH MAGNETICALLY OPERATED SWITCH IN THE CLOSED DOOR POSITION

[75] Inventor: Sidney Fromberg, P.O. Box 2575, Lancaster, Calif. 93539

[73] Assignee: Sidney Fromberg, Lancaster, Calif.

[21] Appl. No.: 08/831,926

[22] Filed: Apr. 2, 1997

[51] Int. Cl.[6] ..... H01H 3/16; H01H 9/00

[52] U.S. Cl. ..... 200/61.67; 335/205; 200/61.68

[58] Field of Search ..... 200/61.62–61.68, 200/61.71–61.75, 61.82; 292/165, 251.5, 340; 70/145; 335/205, 206, 207; 340/545, 547

[56] References Cited

U.S. PATENT DOCUMENTS

| | | | |
|---|---|---|---|
| 2,193,488 | 3/1940 | Morley et al. | 292/340 |
| 3,402,405 | 9/1968 | Contreras | 292/340 |
| 3,770,930 | 11/1973 | Tang | 200/61.68 X |
| 3,851,325 | 11/1974 | Maged | 70/104 X |
| 3,872,696 | 3/1975 | Geringer | 70/145 |
| 3,967,080 | 6/1976 | Errani | 200/61.64 |
| 4,189,692 | 2/1980 | Bonnar | 200/61.67 X |
| 4,248,463 | 2/1981 | Hand | 200/61.64 X |
| 4,580,010 | 4/1986 | Gotanda | 379/49 |
| 4,904,005 | 2/1990 | Frolov | 292/251.5 |
| 5,257,841 | 11/1993 | Geringer et al. | 200/61.68 X |

*Primary Examiner*—J. R. Scott
*Attorney, Agent, or Firm*—Wood, Herron & Evans, LLP

[57] ABSTRACT

A security lock for a door type structure in which a latch extends between the movable door and the fixed jamb. A magnet is contained within the latch and a switch is positioned in the jamb. The magnet passes into switch operating relationship to the switch for the condition of the door closed. When the magnet is moved out of the switch operating relationship to the switch, which occurs prior to the door being opened, the change in the magnetic flux causes the switch to generate an information signal which indicates that an attempt to open the particular door has been made.

15 Claims, 3 Drawing Sheets

SECURITY DOOR LOCK ARRANGEMENT WITH MAGNETICALLY OPERATED SWITCH IN THE CLOSED DOOR POSITION

BACKGROUND OF THE INVENTION

1. Field of the Invention

This invention relates to the door lock art and more particularly to an improved security door lock providing signal information indicating the unauthorized opening of a door.

2. Description of the Prior Art

Security devices are often utilized in various door lock arrangements to protect the privacy and/or contents of businesses, homes apartments and other places. Such security devices as incorporated in doors have often been intended to prevent the unauthorized entry into the premises protected by the security device since conventional door locks including handle operated latching structures and deadbolts can usually be forced or otherwise rendered inoperable. That is, conventional handle operated latches can often be forced open by the insertion of a rigid prying tool or even a stiff plastic such as a credit card between the door and the jamb to force the latch into a retracted position. Even deadbolts can be cut by the insertion of a sawing instrument between the door and the jamb and cutting, through the deadbolt. Further, many alarm devices incorporated into the conventional door lock structures have often been comparatively complicated and/or expensive structures not adapted to the requirements for mass production and installation.

In U.S. Pat. No. 3,402,405 there is shown a self locking burglar alarm system which uses a spring biased bolt arm extending across and through opposite walls of a housing. An audible alarm and switching means are also located in the housing. One end of the bolt arm engages a latch plate near an opening while the other end is used to move the arm back to extend the spring to cock the arm. When the window or door upon which the alarm is mounted is moved, the end of the arm moves from the latch plate into the opening to provide a lock. At the same time the arm actuates the the switching means to trigger the alarm. The device as so disclosed has several disadvantages. First of all, the structure does not lend itself to mass manufacturing and installation techniques to produce a heavy duty lock. Also, since the end of the arm opposite the one engaging the latch plate extends out of the housing, it can be reached through an adjacent window to disable the alarm. Further, the cooperative relationship between the operative end of the bolt arm and the latch plate are such that it is possible for an intruder to move the bolt arm to an inoperative position from outside the area to be protected.

Many other mechanical and/or electromechanical security devices have been proposed for incorporation into security devices for various purposes. However, a security device operated by magnetic forces has not heretofore been available for inclusion in mass production and installation techniques.

In U.S. Pat. No. 2,193,488 there is shown a refrigerator lock mechanism with a switch to activate the light within the refrigerator. No magnetically operated structure is provided. In U.S. Pat. No. 3,770,930 there is shown a safety switch for a microwave oven which employs an irregular shaped actuator that only allows power to turn on when the microwave door is closed and the actuator is meshed.

In U.S. Pat. No. 3,851,325 there is shown a lock and alarm structure utilizing a spring and a bolt. An alarm 66 is also provided with batteries in the lock housing. In the armed position, if the door is moved, the bolt slips from a shoulder and the spring pushes the bolt forward to activate the alarm. In U.S. Pat. No. 4,248,463 there is shown a security system with a dead bolt lock and sensing and control means for sensing whether or not the lock is in the locked position. Means are also provided to activate and deactivate the alarm and also to utilize an information signal generated by the structure to operate an electric appliance. In U.S. Pat. No. 5,257,841 there is disclosed an electrical lock strike device to monitor whether a deadbolt is present or not.

In none of the prior art patents is there even shown or suggested the use of a magnet with the attendant use of magnetic forces to provide the actuation of an alarm system. Thus, there has long been a need for a magnetically operated security lock which can be conveniently incorporated into existing lock structures for mass production and installation without requiring major rework or rededsign of the basic lock structure.

BRIEF DESCRIPTION OF THE INVENTION

Accordingly, it is an object of the present invention to provide a security lock operated by magnetic forces.

It is another object of the present invention to provide a magnetically actuated alarm arrangement which may be incorporated into locks for doors and other locking structures, It is yet another object of the present invention to provide a magnetically operated security lock which may be incorporated into present lock structure with a minimum of redesign and/or rework for mass manufacturing and installation thereof.

The above, and other objects of the present invention are achieved, in a preferred embodiment thereof, in a door lock arrangement. While the present invention is described as incorporated into a door lock, it will be appreciated that the invention may be incorporated into many different structures to provide a security arrangement. The door utilized in describing the present invention is of the type hung in a door jamb. In many structures such as residential housing, the door jamb is mounted on a frame of doubled 2 by 4's. However, for convenience, the jamb and doubled 2 by 4's to which the jamb is attached are collectively referred to as the jamb even though part of the invention may be in the 2 by 4's. The preferred embodiment of the present invention incorporates a magnet in the latch member of the latching means. The latching means may be a handle operated latch on the door which is spring loaded to enter into a cavity of the jamb, may be a manually operated deadbolt, or other latching means. A reed switch is incorporated into the jamb and communicates with the cavity accepting the latch member. The reed switch may be a normally open or a normally closed reed switch. When the door is in the closed position the latch member carrying the magnet enters into a latch receiving cavity in the jamb and is in switch operating relationship to the switch in the jamb. Upon being subjected to a change in the magnetic flux of the magnetic forces from the magnet, the switch changes its condition and generates an information signal to indicate that the magnet has moved away from the switch operating relationship to the switch which condition occurs preparatory to the door being opened. The information signal indicates that an attempt is being made to open the door and it may be connected to conventional alarm means such as a siren, bell, or the like and/or into a status panel to indicate that the attempt to open the door has been made. A conventional disabling means may be incorporated into the circuitry to prevent the information signal from being generated in the event that the attempt to open the door is authorized. Such disabling means and devices using the information signal thus generated are not, per se, part of the present invention. Further, the latching means for operating the latch member carrying the magnet are not, per se, a part of the present invention. In those embodiments of the present invention where a status board is utilized to monitor the status of a plurality of doors, such as in an apartment complex, the information signal may be used to provide a light and is generated when the door is closed and the magnet is in switch operating relationship to the switch. In such an embodiment, the light on the status board for each door indicates that the door is closed and the if the magnet is moved out of the switch operating relationship to the swich the information signal is terminated and the light goes out which indicates an attempt is being made to open the door. Alternatively, there may be no signal generated when the latch is in switch operating relationship to the switch and no light is on the status board, thus indicating that the door is closed and the information signal is generated when the magnet moves out of the switch operating relationship to the switch and the light goes on at the status board. Thus, in those embodiments of the present invention used with a status board, the "information signal" may be either the generation of the actuating signal for lighting the status light or the termination of the actuating signal to extinguish the light. In those embodiments of the present invention used with other alarms such as a siren or the like, the "information signal" is the signal that actuates the alarm for the condition of the magnet moved away from the switch operating relationship to the switch.

In some embodiments of the present invention, the magnet is an elongated cylinder which bridges the space between the door and the jamb when the door is in the closed position and the latch member protrudes into the jamb. The magnet is rotatably mounted in the magnet receiving cavity in the latch member by having the magnet receiving cavity with a slightly larger diameter than the magnet so that the magnet may rotate. If an attempt to cut the latch member is made, the rotation of the magnet prevents the sawing instrument from cutting into through the latch member.

In another embodiment of the present invention, the magnet may be provided by a magnetic coating of magnetic material on the outer face of the latch member. In another embodiment of the present invention, the magnet may be a thin disc magnet. In yet another embodiment of the present invention, the entire latch member, whether a deadbolt, lock bar, tapered spring loaded latch or otherwise, may be a magnet.

In each of the above described preferred embodiments of the present invention only a minimal amount of redesign and/or modification to existing structures is required to incorporate the invention into presently available lock hardware.

BRIEF DESCRIPTION OF THE DRAWINGS

The above and other embodiments of the present invention maybe more fully understood from the following detailed description taken together with the accompanying drawing in which similar reference characters refer to similar elements throughout and in which.

DESCRIPTION OF THE PREFERRED EMBODIMENTS

Figure 1:
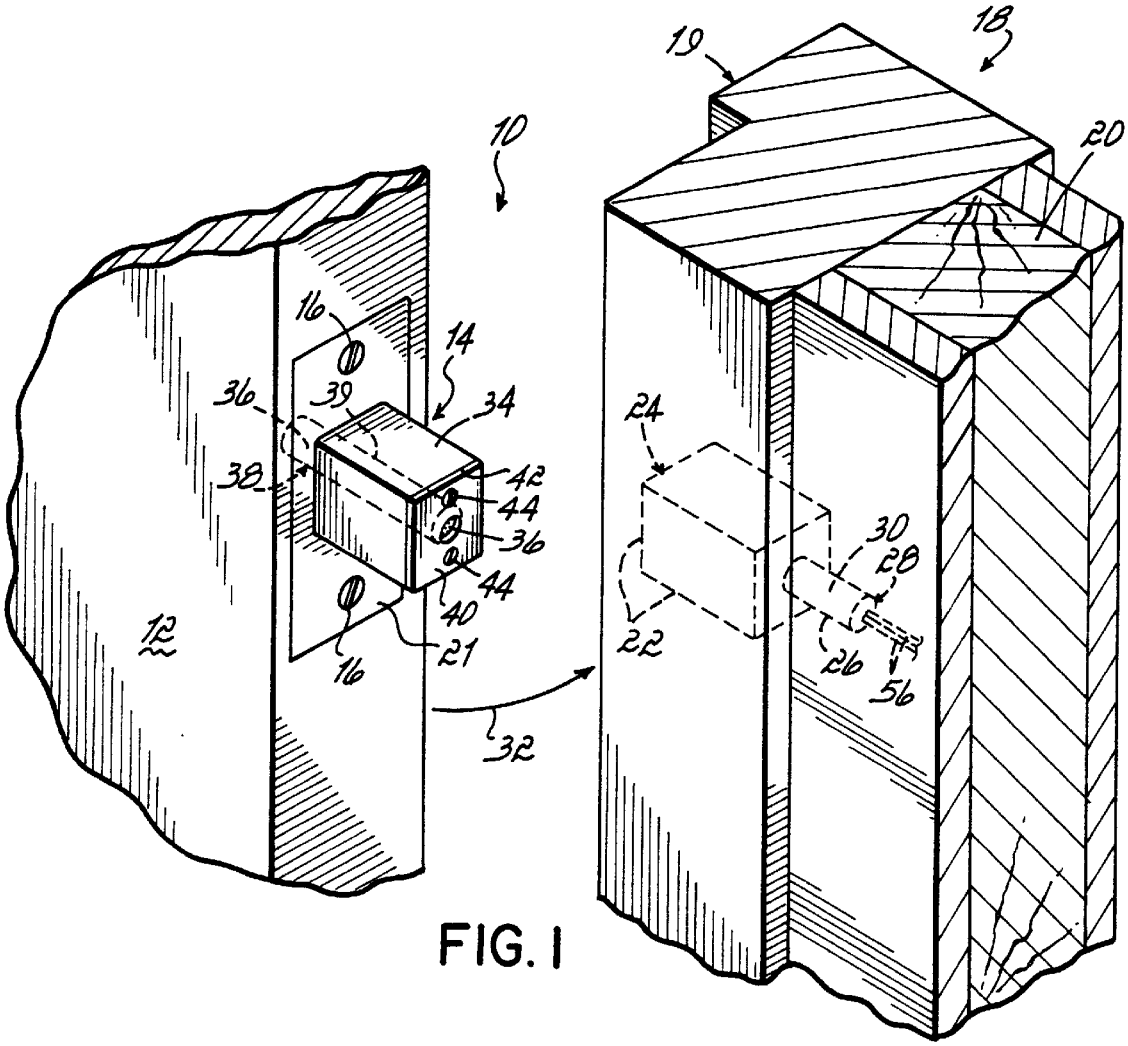
FIG. 1 is a perspective view of a preferred embodiment of the present invention with the door in the open position and as incorporated in a deadbolt.

Referring now to the drawing, there is shown in FIG. 1 a perspective view of an embodiment, generally designated 10, consistent with the present invention. As shown on FIG. 1 there is a door 12 having a deadbolt means generally designated 14 mounted to the door 12 by a mounting plate 21 therein by, for example, screw means 16. An outer door jamb 19 which is associated with the door 12 is also shown on FIG. 1 and the door is in the open position thereof as illustrated in FIG. 1. For illustration purposes, the deadbolt means 14 is shown in its extended, locked position, although the deadbolt means 14 would be retracted, closed when door 12 is opened, or closed in relation to moving contact with door jamb 18. In many structures the outer door jamb 19 is coupled to doubled 2 in by 4 in studs indicated at 20 as part of the door framing means. For convenience of describing the present invention, the outer door jamb 19 and doubled 2 by 4's 20, or any other structure upon which the outer door jamb 19 may be mounted, are collectively referred to herein as the door jamb 18.

Figure 3:
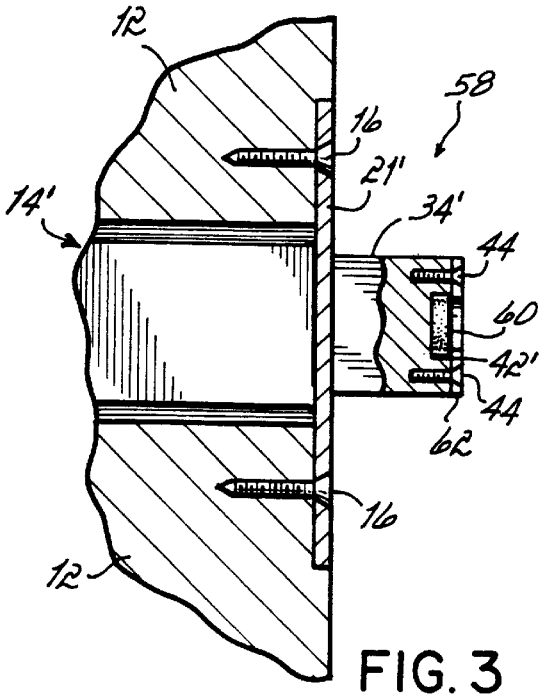
FIG. 3 is a cross-sectional view of a second illustrative embodiment consistent with the present invention.

The door jamb 18 has a latch member receiving cavity 24, which has defining first walls 22, and a switch means receiving cavity. 28, which has defining second walls 26. The switch means receiving cavity 28 opens into and is adjacent to the latch member receiving cavity 24. A magnetically operated switch means 30 is positioned in the switch means receiving cavity 28. The switch means 30 may be a reed switch of the normally open type or of the normally closed type, or may be of the type having both a normally open switch and a normally closed switch in a single switch casing to allow generation of two information signals upon actuation. The switch means 30 may, for example, be a reed switch such as the switch sold by Nutone, Cincinnati, Ohio under model number 4-Q-87. The door 12 is movable in the directions indicated by the double ended arrow 32 from the open position shown in FIG. 1 to a closed position as shown in FIG. 3.

The latching means 14 of the present invention has a latch member 34 which, in the first embodiment 10, is shown as a deadbolt, but may be any other latch member providing the function thereof. The latch member 34 has a magnet means 36 positioned in a magnet receiving cavity 38 defined by first walls 39. A retention plate 40 is coupled to the forward face 42 of the latch member 34 by, for example, screws as indicated at 44, for retaining the magnet means 36 in the magnet receiving cavity 38.The latch member 34 is part of a latching means 14 which may be a manually operated deadbolt structure of conventional design and operation and is retained on the door 12 by, for example screws 16. The portions of such a deadlock structure not illustrated herein are not, per se, part of the present invention.

The retention plate 40 as shown in FIG. 1 is only one type of retention means which may be utilized in the practice of the present invention. Thus, the retention means may comprise a layer of adhesive between the magnet means 36 and the walls 39. the retention means may be a force or interference fit between the magnet means 36 and the walls 39. The retention means may comprise a set screw extending radially through the latch member and engaging the magnet means 36. The magnet means 36 may be retained in the magnet receiving cavity 38 by a threading engagement of thread formed on the outer surface of the magnet means 36 and matching threads on the walls 39. The above described or other retention means may be utilized as desired in any combination in particular applications.

The latch member 34 is reciprocatingly movable in directions indicated by the arrow 46 which, for the condition of the door 12 in the closed position, as described below in connection with the description of FIG. 3, allows a first portion 34*a* of the latch member 34 to move into and out of the latch member receiving cavity 24 of the jamb 18 with a second portion 34*b* of the latch member 34 remaining within the door 12.

Figure 2:
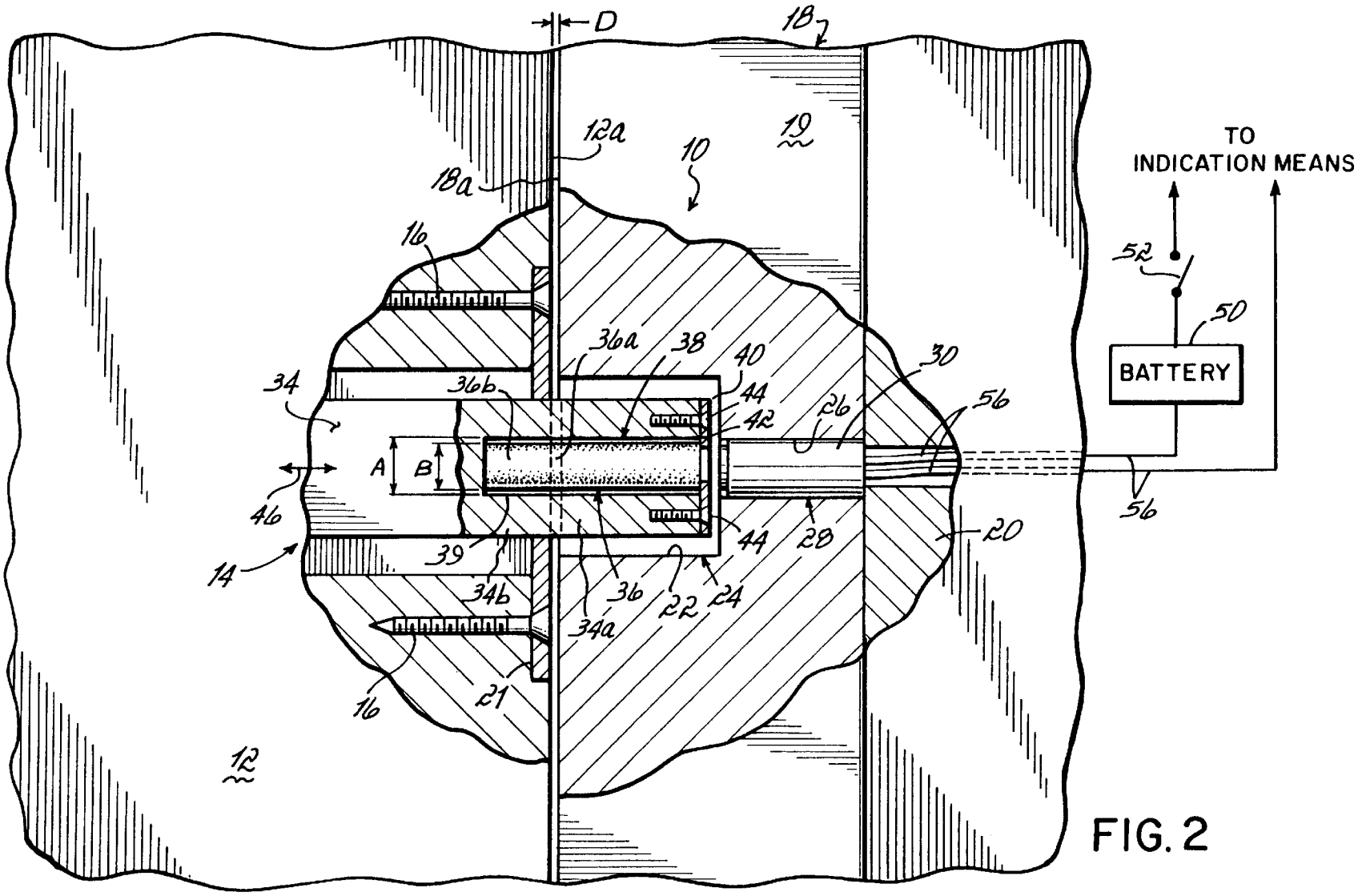
FIG. 2 is a front view partially broken away of a first illustrative embodiment shown in FIG. 1 with the door in the closed position

As shown on FIG. 2, the latch member 34 has the first walls 39 defining the magnet member receiving cavity 38 which is preferably circular in cross section having a first diameter indicated at A. The magnet means 36 is preferably a cylindrical magnet having an axial length substantially equal to the axial length of the magnet receiving cavity 38 and has a diameter indicated at B. In the first embodiment 10 the diameter B is less than the diameter A for reasons hereinafter set out, but, if desired, may be substantially the same diameter.

FIG. 2 illustrates the first embodiment 10 with the door in the closed position thereof with respect to the door jamb 18 and the latch member 34 of the latching means 14 positioned in the latch member receiving cavity 24. In the closed position shown in FIG. 2, the magnet means 36, is in switch operating relationship to the switch means 30. The switch means 30 may be hard wired to a source of electricity (not shown) or may be powered by a battery 50 and placed into operative or inoperative condition by a control switch 52. When the magnet passes into switch operating relationship to the switch 30 and the switch 30 is in an operative condition, the switch 30 is "armed". If the magnet 36 is then removed from switch operating relationship to the switch 30, the switch 30 changes from a normally open to a normally closed condition (or normally closed to a normally open condition) which generates an information signal in the leads 56. The information signal so generated may be utilized in any indication means (not shown) such as a siren, bell or other auditory alarm, or in a status board showing that the particular door 12, which may be one of many similar doors in, for example, an apartment complex, located at a security guard's desk. In any event, upon detection of the information signal, appropriate remedial action may be taken if the attempted entry is unauthorized. For authorized entry, a conventional disabling means (not shown) may be incorporated into the circuitry so that no signal is generated when the magnet moves out of switch operating relationship to the switch.

Figure 4:
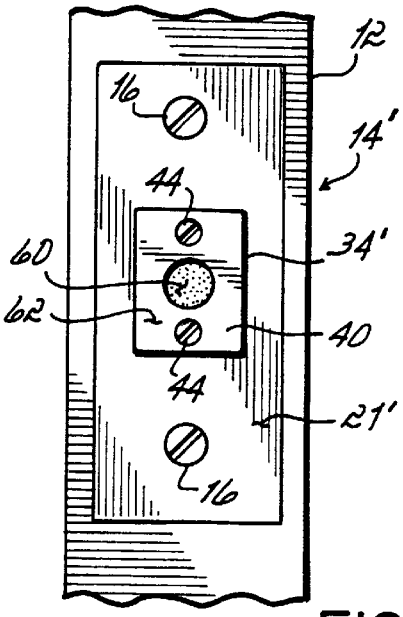
FIG. 4 is a plan view of the second illustrative embodiment of FIG. 4.

FIGS. 3 and 4 illustrate a second embodiment consistent with the present invention generally designated 58 in which a latch member 34' of a latching means 14' which may be a deadbolt is provided with a thin disc magnet 60 retained in the latch member 34' adjacent the forward face 42' thereof. The disc magnet 60 is retained in the latch member 34' by retaining plate 62 by screws indicated at 44. Mounting plate 21' is part of the latching means 34' and is held in place on the door 12' by screws as indicated at 16 in the same manner as the mounting plate 21 is mounted on the door 12 in the, first embodiment 10 described above in connection with FIGS. 1,2 and 3. The magnet 60 operates to control a switch means (not shown) in a manner similar to the action provided by the magnet 36 of the first embodiment 10.

Figure 5:
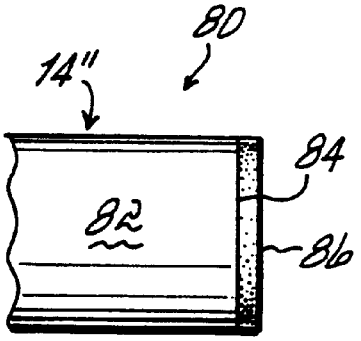
FIG. 5 is a third illustrative embodiment consistent with the present invention showing a deadbolt.

FIG. 5 illustrates a third embodiment consistent with the present invention generally designated 80 of a latching means 14" having a latch member 82 which may be, for example, a deadbolt. The forward face 84 of the latch member 82 is coated with a rubberized magnetic coating 86 to act as the magnet within the principles of the present invention.

In other embodiments of the present invention, a plurality of magnetically operated switches similar to switch means 30 may be utilized and placed in the door jamb as shown for the switch means 30 so that a plurality of information signals may be utilized for a variety of detection means.

For a magnet means 36 installed in a magnet receiving cavity 38 as described above in connection with FIGS. 1, 2 and 3, the smaller diameter of the magnet means 36 provides additional security. As shown in FIG. 2 there is generally a space indicated by D between the outer edge surface 12*a* of the door 12 and the outer edge surface 18*a* of the jamb 18. If a sawing instrument is placed in the space D and an attempt is made to cut through the latch member 34, it will not be possible to cut completely therethrough. In some embodiments consistent with the invention the magnet means 36 will rotate in the cavity 38 and not allow the saw to cut therethrough. The magnet means 36, in other embodiments, may be fabricated from any desired hardened magnet material to aid in the saw resistance properties thereof. Further, in such embodiments, the magnet means 36 for the condition of the door in a closed condition and the latch member 34 inserted into the latch member receiving cavity 24 of the jamb 18 has a portion indicated at 36*a* in the space D and preferably a portion 36*b* in the door 12 so that it is insured that the portion 36*a* is in the space D.

Figure 6:
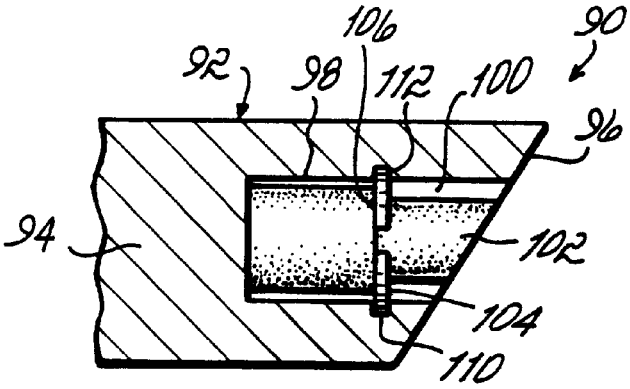
FIG. 6 illustrates a fourth illustrative embodiment consistent with the present invention as incorporated in a handle operated latching means.

FIG. 6 illustrates a fourth embodiment consistent with the invention generally designated 90 in which the latching means 92 is the conventional handle operated type having a latch member 94 with a tapered face 96 which slidingly engages a strike plate (not shown) on a door jamb. The latch member 94 has first walls 98 defining a magnet means receiving cavity 100 in which a magnet 102 is positioned. The magnet 102 is held in place by a snap ring 104 abutting against shoulder 106 of magnet 102. The snap ring 104 is contained in snap ring groove 110 defined by snap ring groove walls 112. The magnet means 102 may be rotatable mounted in the cavity 100 in a manner as described above for the magnet 36 of the first embodiment 10 or may be fixed in place as desired for particular applications.

Figure 7:
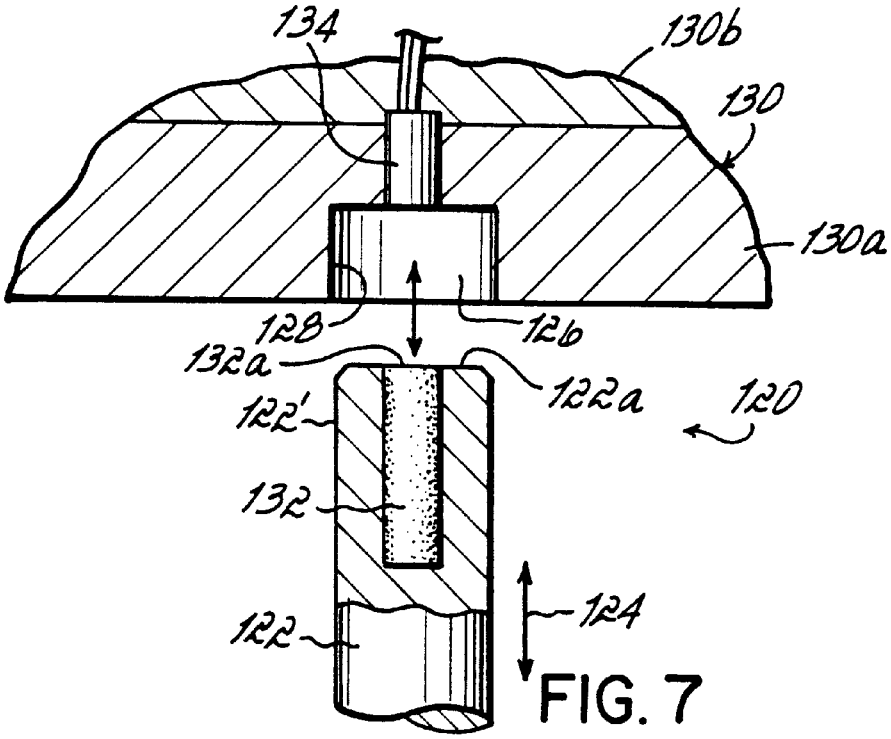
FIG. 7 illustrates another embodiment of the present invention as utilized in a vertical lock bar application.

FIG. 7 illustrates a fifth embodiment 120 of the present invention as utilized in a vertically moving lock bar arrangement. The vertically moving lock bar 122 may be of the type often employed in double door applications or in push bar operated door applications. The lock bar 122 moves reciprocatingly in the vertical directions indicated by the arrow 124. The outer end 122' of the lock bar 122 moves into and out of the cavity 126 formed by walls 128 in header 130 which, in many applications is formed by doubled 2 by 4's 130*a* and 130*b*. A magnet means 132 which may be similar to the magnet means 36 described above, is positioned in the lock bar 122 and has a face 132*a* in regions adjacent the outer surface 122*a* of the lock bar 122. In the embodiment 120, the magnet means 132 is retained in the lock bar 122 by retention means comprising a force or interference fit, though any of the other retention means as described above may also be utilized in particular applications. A switch 134 which may be similar to the switch 30 described above is mounted in the header 130 so that the magnet means 132 passes in switch operating relationship when the outer end 122' of the lock bar 122 is positioned in the cavity 126. If the lock bar is then removed from the cavity 126, the switch 134 changes from, for example, a normally open to a normally closed condition to generate the desired information signal. The information signal may be utilized as described above.

In any of the embodiments of the present invention, the entire latch member, whether a dead bolt, lock bar, spring loaded latch, or the like, may be a magnet depending on the particular application in which the invention is to be utilized.

This concludes the description of the preferred embodiments of the present invention. From the above it can be seen that an improved security door lock has been provided which requires minimal redesign of existing hardware and is readily adaptable to mass manufacturing of presently available lock hardware and minimal changes in door installation.

Those skilled in the art will find many variations and adaptations of the structure shown and described herein. The following claims are intended to cover all the variations and adaptations falling within the true scope and spirit of the invention.

What is claimed is:

1. An improved security lock arrangement comprising, in combination:

a door having an outer edge surface, the door movable from an open position to a closed position;

a door jamb having first walls defining latch member receiving cavity opening toward and adjacent to the door outer edge surface when the door is in the closed position, the door jamb having second walls defining a switch receiving cavity opening into and adjacent to said latch receiving cavity, the latch receiving cavity positioned between the switch receiving cavity and the door outer edge surface when the door is in the closed position;

a latching means mounted in said door and having a latch member having a first portion reciprocatingly movable for extension into and out of said latch member receiving cavity of said door jamb for the condition of said door in said closed position, and a second portion in said door, said first portion having an outer face movable into said latch member receiving cavity of said door jamb and in alignment with said switch receiving cavity of said door jamb for said door in said closed position;

said latch member receiving cavity of said door jamb in alignment with said switch receiving cavity of said door jamb for said door in said closed position, and said first portion having walls defining a magnet receiving cavity extending from said outer face toward said second portion of said latch member;

a magnet means retained in said magnet receiving cavity of said latch member and having an outer face in regions adjacent said outer face of said latch member and movable into switch actuating relationship to said switch receiving cavity of said door jamb for said door in said closed position; and a switch means mounted in said switch receiving cavity of said door jamb for generating an information signal for the condition of said magnet means moved into switch actuating relationship to said switch receiving cavity.

2. The arrangement defined in claim 1 wherein:

said magnet receiving cavity in said latch means is an elongated cylindrical cavity having a predetermined axial length and a first predetermined diameter; and said magnet means is cylindrical and has a second predetermined diameter less than said first predetermined diameter, and said magnet means rotatably retained in said magnet receiving cavity.

3. The arrangement defined in claim 2 wherein:

said magnet means and said magnet receiving cavity have substantially the same axial length.

4. The arrangement defined in claim 2 wherein:

said jamb has an outer edge surface;

said outer edge surface of said door is positioned a first predetermined spacing from said outer edge surface of said jamb for the condition of said door in a closed position;

said magnet means has a middle portion positioned in said first predetermined spacing for the condition of said door in said closed position.

5. The arrangement defined in claim 1 wherein:

said switch means is a normally open reed switch and closes to generate said information signal for the condition of said magnet means in switch operating relationship to said switch receiving cavity.

6. The arrangement defined in claim 1 wherein:

said switch means is a normally closed reed switch and opens to generate said information signal for the condition of said magnet means in switch operating relationship to said switch receiving cavity.

7. The arrangement defined in claim 1 wherein:

said magnet means is a disc magnet.

8. The arrangement defined in claim 1 wherein:

said latch member of said latching means is non-magnetic.

9. The arrangement defined in claim 1 wherein:

said latch member is a dead bolt.

10. The arrangement defined in claim 1 wherein:

said latch member is a lock bar moving vertically with respect to said jamb.

11. The arrangement defined in claim 1 wherein:

said latch member moves horizontally with respect to said jamb.

12. An improved security lock arrangement comprising, in combination:

a door having an outer edge surface, the door movable from an open position to a closed position;

a door jamb having first walls defining latch member receiving cavity opening toward and adjacent to the door outer edge surface when the door is in the closed position, the door jamb having second walls defining a switch receiving cavity opening into and adjacent to said latch receiving cavity, the latch receiving cavity positioned between the switch receiving cavity and the door outer edge surface when the door is in the closed position;

a latching means mounted in said door and having a latch member having a first portion reciprocatingly movable for extension into and out of said latch member receiving cavity of said door jamb for the condition of said door in said closed position, and a second portion in said door, said first portion having an outer face movable into said latch member receiving cavity of said door jamb and in alignment with said switch receiving cavity of said door jamb for said door in said closed position, and said latch member comprises a non-magnetic deadbolt;

a magnetic coating means on said outer face of said latch member; and a switch means mounted in said switch receiving cavity of said door jamb for generating an information signal for the condition of said magnetic coating means moved into switch actuating relationship to said switch receiving cavity.

13. The arrangement defined in claim 12 wherein:

said switch means is a normally open reed switch and closes to generate said information signal for the condition of said magnetic coating means in switch operating relationship to said switch receiving cavity.

14. The arrangement defined in claim 12 wherein:

said switch means is a normally closed reed switch and opens to generate said information signal for the condition of said magnetic coating means in switch operating relationship to said switch receiving cavity.

15. An improved security lock arrangement comprising, in combination:

a door having an outer edge surface, the door movable from an open position to a closed position;

a door jamb having first walls defining latch member receiving cavity opening toward and adjacent to the door outer edge surface when the door is in the closed position, the door jamb having second walls defining a switch receiving cavity opening into and adjacent to said latch receiving cavity, the latch receiving cavity positioned between the switch receiving cavity and the door outer edge surface when the door is in the closed position;

a latching means mounted in said door and having a latch member having a first portion reciprocatingly movable for extension into and out of said latch member receiving cavity of said jam for the condition of said door in said closed position, and a second portion in said door, said first portion having an outer face movable into said latch member receiving cavity of said jam and alignment with said switch receiving cavity of said jam for said door in said closed position, and said latch member comprises a magnetic latch member; and a switch means mounted in said switch receiving cavity of said jam for generating an information signal for the condition of said magnetic latch member moved into switch actuating relationship to said switch receiving cavity.

* * * * *